US010098808B2

(12) United States Patent
Poole et al.

(10) Patent No.: US 10,098,808 B2
(45) Date of Patent: Oct. 16, 2018

(54) ANTI-AGING APPLICATOR

(71) Applicant: L'Oreal, Paris (FR)

(72) Inventors: Aaron David Poole, Federal Way, WA (US); Gerald Keith Brewer, Redmond, WA (US); Elisa Caberlotto, Paris (FR); Zane Bowman Allen Miller, Seattle, WA (US)

(73) Assignee: L'Oreal, Paris (FR)

( * ) Notice: Subject to any disclaimer, the term of this patent is extended or adjusted under 35 U.S.C. 154(b) by 677 days.

(21) Appl. No.: 14/587,587

(22) Filed: Dec. 31, 2014

(65) Prior Publication Data

US 2016/0184171 A1 Jun. 30, 2016

(51) Int. Cl.

| | |
|---|---|
| ***A61H 7/00*** | (2006.01) |
| ***A61H 1/00*** | (2006.01) |
| ***A61H 23/02*** | (2006.01) |

(52) U.S. Cl.

CPC ..... *A61H 7/00* (2013.01); *A61H 1/00* (2013.01); *A61H 7/005* (2013.01); *A61H 23/02* (2013.01); *A61H 2201/0153* (2013.01); *A61H 2201/0165* (2013.01); *A61H 2201/105* (2013.01); *A61H 2201/1223* (2013.01); *A61H 2201/1654* (2013.01); *A61H 2201/1669* (2013.01);

(Continued)

(58) Field of Classification Search

CPC ... A61H 7/005; A61H 23/02; A61H 2201/105

See application file for complete search history.

(56) References Cited

U.S. PATENT DOCUMENTS

| | | | |
|---|---|---|---|
| 4,291,685 | A | 9/1981 | Taelman |
| 5,088,474 | A | 2/1992 | Mabuchi et al. |

(Continued)

FOREIGN PATENT DOCUMENTS

| | | | |
|---|---|---|---|
| DE | 20 2013 103 057 | U1 | 9/2013 |
| FR | 2 992 856 | A1 | 1/2014 |

(Continued)

OTHER PUBLICATIONS

International Search Report and Written Opinion dated Jun. 15, 2016, issued in corresponding International Application No. PCT/US2015/067906, filed Dec. 29, 2015, 21 pages.

(Continued)

*Primary Examiner* — Michael Tsai

(74) *Attorney, Agent, or Firm* — Christensen O'Connor Johnson Kindness PLLC

(57) ABSTRACT

An end effector is capable of being used to stimulate a portion of skin at a stimulation frequency. The end effector includes a base portion that is couplable to a motor and an end portion having a plurality of contact points at which the end effector is configured to contact the portion of skin. The plurality of contact points are located at a target distance from each other that is based on an inverse of the stimulation frequency. The end effector is configured such that, when the base portion is coupled to the motor and the motor is operating, the end effector has a resonant frequency based on the stimulation frequency. When the motor is operating and a force is applied to bias the end effector toward the portion of skin, a cyclical stimulus is produced within the portion of skin at about the stimulation frequency.

19 Claims, 14 Drawing Sheets

(52) U.S. Cl.
CPC ..... *A61H 2201/1671* (2013.01); *A61H 2201/1685* (2013.01)

(56) References Cited

U.S. PATENT DOCUMENTS

| | | | | |
|---|---|---|---|---|
| 5,803,916 | A * | 9/1998 | Kuznets | A61H 7/004 601/101 |
| 8,382,690 | B2 * | 2/2013 | Yoon | A61H 7/005 600/476 |
| 9,205,020 | B2 * | 12/2015 | Young | A61H 15/0078 |
| 2002/0156402 | A1 * | 10/2002 | Woog | A61H 23/0236 601/46 |
| 2005/0277950 | A1 | 12/2005 | Pilcher et al. | |
| 2005/0280319 | A1 | 12/2005 | Pilcher et al. | |
| 2008/0262397 | A1 | 10/2008 | Habatjou | |
| 2009/0318852 | A1 * | 12/2009 | Reed | A61M 35/003 604/22 |
| 2010/0222719 | A1 * | 9/2010 | Cowie | A61H 7/005 601/46 |
| 2011/0270137 | A1 * | 11/2011 | Goren | A61N 7/02 601/2 |
| 2013/0138023 | A1 | 5/2013 | Lerro | |
| 2014/0309662 | A1 | 10/2014 | Brewer et al. | |

FOREIGN PATENT DOCUMENTS

| | | |
|---|---|---|
| GB | 385711 | 1/1933 |
| JP | 2004-526517 A | 9/2004 |
| JP | 2007-209533 A | 8/2007 |
| JP | 2007-523712 A | 8/2007 |
| JP | 2008-155115 A | 7/2008 |
| JP | 2014-520646 A | 8/2014 |

OTHER PUBLICATIONS

Farran, A.J.E., et al., "Design and Characterization of a Dynamic Vibrational Culture System," Journal of Tissue Engineering and Regenerative Medicine 7(3):213-225, Mar. 2013.

Gaston, J., et al., "The Response of Vocal Fold Fibroblasts and Mesenchymal Stromal Cells to Vibration," PLoS One 7(2):e30965, Feb. 2012, 9 pages.

Ito, Y., et al., "Nano-Vibration Effect on Cell Adhesion and Its Shape," Bio-Medical Materials and Engineering 21(3):149-158, 2011.

Kutty, J.K., and K. Webb, "Vibration Stimulates Vocal Mucosa-Like Matrix Expression by Hydrogel-Encapsulated Fibroblasts," Journal of Tissue Engineering and Regenerative Medicine 4(1):62-72, Jan. 2010.

Makous, J.C., et al., "A Critical Band Filter in Touch," Journal of Neuroscience 15(4):2808-2810, Apr. 1995.

Scheibert, J., et al., "The Role of Fingerprints in the Coding of Tactile Information Probed With a Biomimetic Sensor," Science 323(5920):1503-1506, Mar. 2009.

Invitation to Pay Additional Fees and Partial International Search dated Apr. 18, 2016, issued in corresponding International Application No. PCT/US2015/067906, filed Dec. 29, 2015, 8 pages.

International Search Report and Written Opinion dated Mar. 17, 2016, issued in corresponding International Application No. PCT/US2015/065818, filed Dec. 15, 2015, 14 pages.

International Search Report and Written Opinion dated Mar. 17, 2016, issued in corresponding International Application No. PCT/US2015/065805, filed Dec. 15, 2015, 14 pages.

International Preliminary Report on Patentability and Written Opinion dated Jul. 13, 2017, issued in corresponding International Application No. PCT/US2015/067906, filed Dec. 29, 2015, 15 pages.

International Preliminary Report on Patentability and Written Opinion dated Jul. 13, 2017, issued in corresponding International Application No. PCT/US2015/065818, filed Dec. 15, 2015, 11 pages.

International Preliminary Report on Patentability and Written Opinion dated Jul. 13, 2017, issued in corresponding International Application No. PCT/US2015/065805, filed Dec. 15, 2015, 11 pages.

Notice of Reasons for Refusal, dated Mar. 13, 2018, issued in corresponding Japanese Application No. 2017-551565, filed Dec. 15, 2015, 6 pages.

Office Action, dated Jun. 26, 2018, issued in corresponding Japan Application No. 2017-534782, filed Dec. 29, 2015, 6 pages.

Notice of Reason for Refusal, dated Jun. 12, 2018, issued in corresponding Japan Application No. 2017-551566, filed Dec. 15, 2015, 6 pages.

* cited by examiner

ANTI-AGING APPLICATOR

CROSS REFERENCES TO RELATED APPLICATIONS

The present application is related to U.S. patent application Ser. No. 14/588,209, entitled "SYSTEMS AND METHODS FOR REGULATION OF ONE OR MORE EPIDERMAL PROTEINS," filed Dec. 31, 2014, to U.S. patent application Ser. No. 14/588,230, entitled "SYSTEMS AND METHODS FOR REGULATION OF ONE OR MORE CUTANEOUS PROTEINS," filed Dec. 31, 2014, and to U.S. patent application Ser. No. 14/588,255, entitled "SYSTEMS AND METHODS FOR REGULATION OF ONE OR MORE EPIDERMAL OR DERMOEPIDERMAL PROTEINS," filed Dec. 31, 2014 , the contents of which are hereby incorporated by reference in their entirety.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a system for stimulating a portion of skin at a stimulation frequency includes an appliance having a motor and an end effector operably coupled to the motor. The end effector includes a plurality of contact points at which the end effector is configured to contact the portion of skin. The plurality of contact points are located at a target distance from each other that is based on an inverse of a target stimulation frequency. The motor is configured to move the end effector such that, when the motor is operating, the system has a resonant frequency based on the target stimulation frequency. When the motor is operating and a force is applied to the system to bias the end effector toward the portion of skin, the end effector produces a cyclical stimulus within the portion of skin at about the target stimulation frequency.

In one example, the end effector includes a cup-shaped end configured such that the plurality of contact points are the only portions of the end effector to contact the portion of skin when the force is applied from the end effector to the portion of skin. In another example, the motor is configured to impart one or more of oscillatory motion, vibrational motion, or cyclical mechanical strain to the end effector. In another example, the end effector includes a base portion and an end portion. In another example, the base portion has a mass selected such that the system has the resonant frequency when the motor is operating. In another example, the end portion includes the plurality of contact points, and wherein the end portion is connected to the base portion via a central support such that the plurality of contact points are cantilevered away from the central support. In another example, the end effector is releasably couplable to the appliance, the end effector includes a drive assembly that engages a drive hub of the appliance when the end effector is releasably coupled to the appliance, and the motor is operatively coupled to the drive hub such that operation of the motor causes movement of the drive hub that is transferred to the drive assembly to move the end effector.

In another embodiment, an end effector for stimulating a portion of skin at a stimulation frequency includes a base portion that is couplable to a motor and an end portion having a plurality of contact points at which the end effector is configured to contact the portion of skin. The plurality of contact points are located at a target distance from each other that is based on an inverse of the stimulation frequency. The end effector is configured such that, when the base portion is coupled to the motor and the motor is operating, the end effector has a resonant frequency based on the stimulation frequency. When the motor is operating and a force is applied to bias the end effector toward the portion of skin, a cyclical stimulus is produced within the portion of skin at about the stimulation frequency.

In one example, the plurality of contact points includes at least three contact points arranged equidistantly from each other. In another example, a distance between each set of two of the three contact points is a whole increment of the inverse of the stimulation frequency. In another example, each of the plurality of contact points is located on one of a plurality of pads and edges of each of the plurality of pads has a rounded shoulder. In another example, each of the plurality of pads has at least one of a rounded shoulder, at least one slit across a face of the pad, or surface texturing on a face. In another example, a surface of the end has a hardness in a range from about 10 Shore A to about 60 Shore A. In another example, the end effector includes a ball dispenser configured to dispense a treatment composition to the portion of skin in response to the ball dispenser coming into contact with the portion of skin. In another example, the stimulation frequency is in a range from about 60 Hz to about 120 Hz. In another example, the force applied from the end effector to the portion of skin is in a range from about 85 grams-force to about 100 grams-force.

In another embodiment, a method of treating a portion of skin at a stimulation frequency using an appliance comprising a motor coupled to an end effector includes driving at a resonant frequency an end effector having a plurality of contact points located at a distance from each other that is based on an inverse of a target stimulation frequency and inducing a cyclical stimulus at about the target stimulation frequency within a portion of skin contacted by the plurality of contact points.

In one example, the method further includes applying a composition to the portion of skin using the end effector while driving the end effector at the resonant frequency. In another example, applying the composition includes applying a composition configured to treat a condition of the portion of skin. In another example, driving the end effector at the resonant frequency includes selecting the target stimulation frequency based on the condition of the portion of skin.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1A:
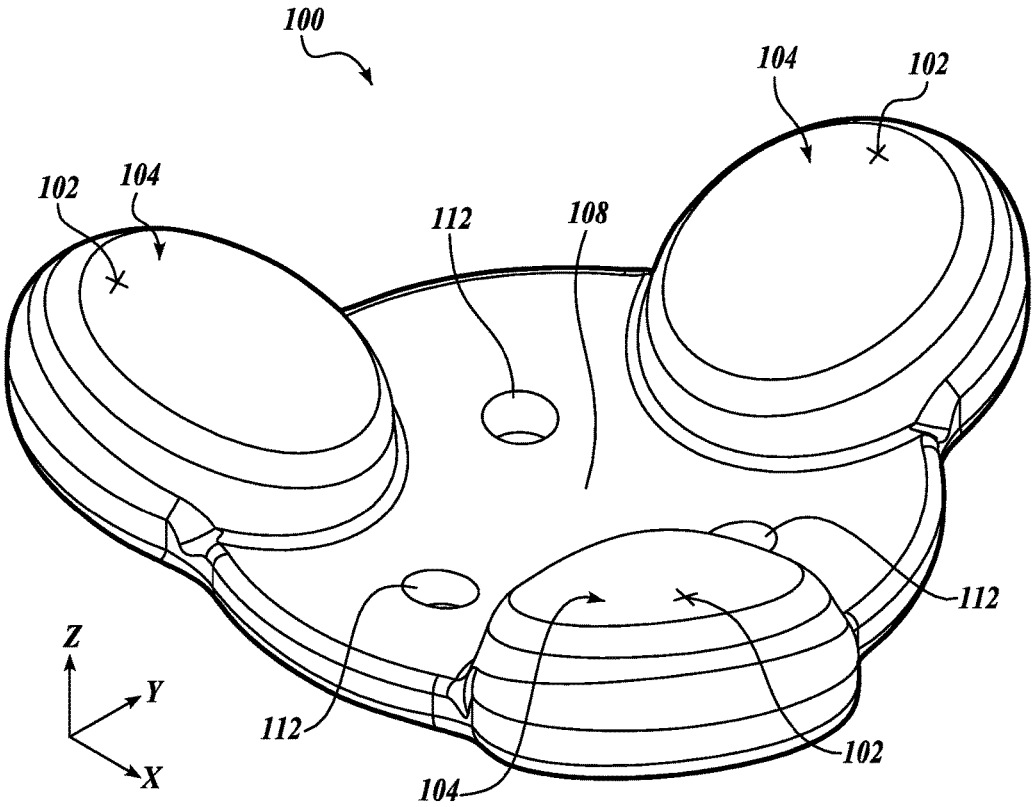
FIGS. 1A, 1B, and 1C depict, respectively, a perspective view, a side view, and a top view of an embodiment of an end effector.

Various forms of energy input into biological organisms have different effects on the biological organisms. These forms of energy input include mechanical inputs, thermal inputs, electromagnetic inputs, electrical inputs, acoustic inputs, and the like. One particular field of study, known as mechanobiology, aims to understand how physical forces and changes in cell or tissue mechanics affect biological organisms.

Under certain conditions, mechanical stimuli (e.g., applied cyclical strain, mechanical motion, applied strain, and the like) input to a portion of skin of a biological organism causes an increase in biomarker (e.g., protein) production. In one example, a number of proteins within the skin can be regulated using, among other things, cyclical mechanical strain applied at particular frequencies using an end effector. The disclosed embodiments employ technologies and methodologies that stimulate frequency response of cells in the dermis and epidermis to induce production of proteins associated with young, healthy skin. Human skin cells (dermal fibroblasts in particular) respond to strain in tissue with cytoskeletal reordering and increased production in extracellular matrix proteins. In an embodiment, by combining discrete, differential strain in the skin at specific frequencies, the disclosed technologies and methodologies induce increased growth and repair activities from multiple cell types found in the skin, thereby producing an anti-aging effect. Depending on the particular location of the portion of skin in a biological organism, mechanical motion or strain generated in a range from about 60 Hz to about 120 Hz may stimulate anti-aging effects.

In an embodiment, the cumulative effects of applying cyclical mechanical strain as disclosed include one or more anti-aging effects. For example, by applying a particular stress to the skin, cutaneous cells will react to the stress by upregulating (increasing) production of certain proteins. The character and duration of the stress will affect which proteins are upregulated and to what extent. As a non-limiting example of the benefits achievable, certain disclosed embodiments can be used to upregulate the production of integrin in the skin, which results in anti-aging effects by increasing epidermal cohesion.

The following discussion provides examples of systems, apparatuses, and methods for implementing technologies and methodologies for stimulating a portion of skin at a stimulation frequency in order to improve skin health through upregulating production of certain proteins within the portion of skin. In an embodiment, an end effector with a plurality of contact points is used for stimulating a portion of skin at a stimulation frequency where the contact points are located a target distance from each other that is based on an inverse of the stimulation frequency. In an embodiment, a system for stimulating a portion of skin at a stimulation frequency includes an appliance and an end effector with a plurality of contact points that are located a distance from each other that is based on an inverse of the stimulation frequency. In an embodiment, a method for stimulating a portion of skin at a stimulation frequency includes activating operation of a motor to impart movement to an end of an end effector and applying a force to bias the end effector toward the portion of skin to cause a cyclical stimulus of the portion of skin at about the stimulation frequency. Examples of cyclical stimuli include cyclical mechanical strain induced in the portion of skin, cyclical pressure waves induced into the portion of skin, and the like.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1B:
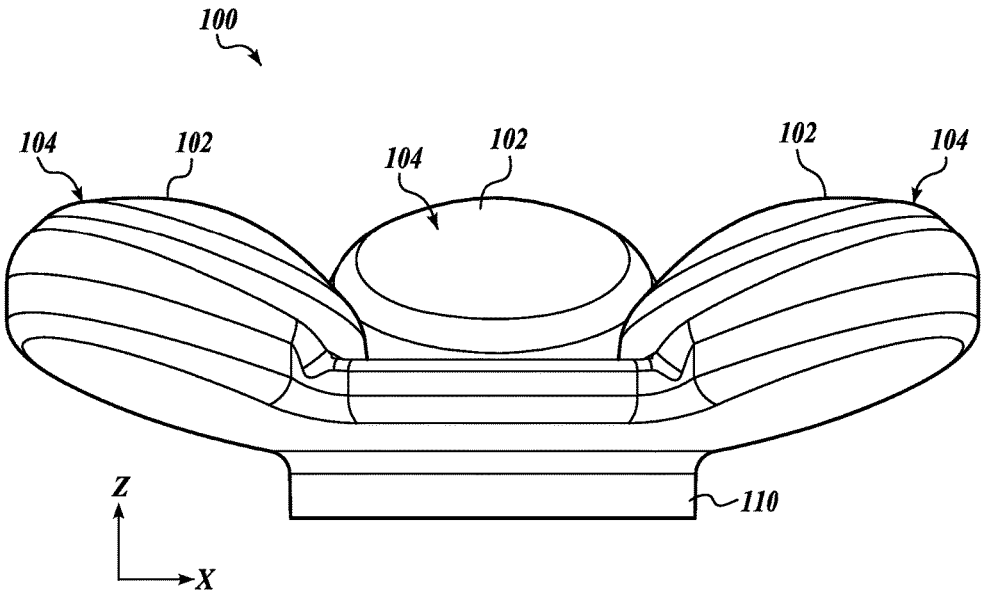
Figure 1C:
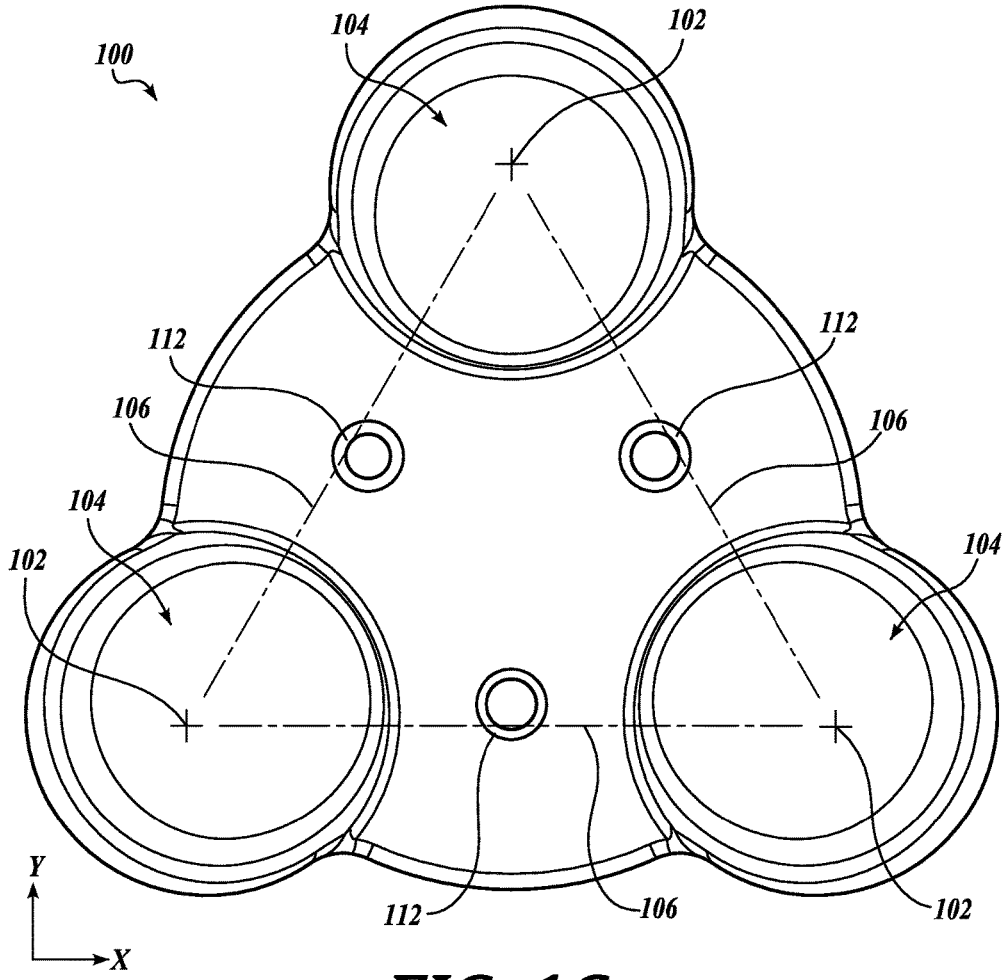

An embodiment of an end effector 100 is depicted in FIGS. 1A to 1C. The end effector 100 includes contact points 102. In an embodiment, contact points 102 can take a variety of shapes, configurations, and geometries including spheroidal, polygonal, cylindrical, conical, planar, parabolic, as well as regular or irregular forms.

The end effector 100 also includes contact areas 104. Each of the contact points 102 is located on one of the contact areas 104. In an embodiment, the contact points 102 are located a target distance 106 away from each other. For example, in an embodiment, the contact points 102 are located a target distance 106 away from each other determined from the inverse of the stimulation frequency. In the particular embodiment shown in FIGS. 1A to 1C, the contact points 102 include the contact points that are equidistant from each other (i.e., the distances 106 between contact points 102 are all about the same, such as being within ±5% of each other). The end effector 100 includes a central portion 108 located between the contact areas 104. FIGS. 1A to 1C depict a coordinate system with X-, Y-, and Z-directions. In the Z-direction, the central portion 108 is depressed from the contact areas 104 such that the contact points 102 of the contact areas 104 are the points at which the contact areas 104 would contact a flat object lowered in the Z-direction.

The end effector 100 includes a central support 110 on the opposite side of the central portion 108. As is seen in FIG. 1B, the contact areas 104 are located on portions of end effector 100 that are cantilevered out from the central support 110. In one embodiment, the end effector 100 is made of a non-rigid material. Some examples of non-rigid materials include plastics (e.g., polyurethane), elastomeric materials (e.g., thermoplastic elastomers), rubber materials, and any combinations thereof. In one example, the non-rigid material of the end effector 100 has a hardness in a range from about 10 Shore A to about 60 Shore A, as defined by the American Society for Testing and Materials (ASTM) standard D2240. When the end effector 100 is made of a non-rigid material and the contact areas 104 are located on portions of end effector 100 that are cantilevered out from the central support 110, the portions of end effector 100 with the contact areas 104 have a spring-like quality that permits some movement of the contact areas 104 in the Z-direction.

In the embodiment shown in FIGS. 1A and 1C, the end effector 100 includes fastener holes 112. In one embodiment, mechanical fasteners (e.g., screws, bolts, rivets, etc.) are placed in the fastener holes 112 to mechanically fasten the end effector 100 to another component. In one embodiment, the end effector 100 is couplable to a motor that is configured to move the end effector. In one example, when the end effector 100 is couplable to a motor and the motor is operating, the motor oscillates the end effector 100 with rotational movements about an axis in the Z-direction.

In one embodiment, the end effector 100 is used to stimulate a portion of skin at a stimulation frequency. In one embodiment, the end effector 100 is used to induce a cyclical response within a portion of skin at a target frequency. In one embodiment, the end effector 100 is used to apply a cyclical mechanical strain to a portion of skin responsive to an applied potential. In an embodiment, the appliance 302 is configured to manage a duty cycle associated with driving an end effector. For example, in an embodiment, the appliance 302 includes circuitry configured to manage a duty cycle associated with driving an end effector.

In one example, the stimulation frequency is selected based on a condition of the portion of skin. For example, the stimulation frequency is selected based on an anti-aging effect that is activated by cyclical mechanical strain of the portion of skin at the stimulation frequency. The contact points 102 are located at a target distance from each other based on an inverse of the stimulation frequency. For example, with a stimulation frequency of 60 Hz, the inverse of the stimulation frequency (i.e., the period) is 0.0167 seconds per cycle. With a propagation speed of 2.0 meters per second, the wavelength is 0.0333 meters per second, or 3.33 cm per second. Other examples of wavelength distances based on frequency are shown in TABLE 1.

TABLE 1

Example wavelength distances based on frequency

| Frequency (f) Hz (cycle/sec) | Period (T) (sec/cycle) | Speed[1] (v) (m/s) | Wavelength (λ) (m/cycle) | Wavelength (λ) (cm/cycle) |
|---|---|---|---|---|
| 60 | 0.0167 | 2.0 | 0.0333 | 3.33 |
| 65 | 0.0154 | 2.0 | 0.0308 | 3.08 |
| 70 | 0.0143 | 2.0 | 0.0286 | 2.86 |
| 75 | 0.0133 | 2.0 | 0.0267 | 2.67 |
| 80 | 0.0125 | 2.0 | 0.0250 | 2.50 |
| 85 | 0.0118 | 2.0 | 0.0235 | 2.35 |
| 90 | 0.0111 | 2.0 | 0.0222 | 2.22 |
| 95 | 0.0105 | 2.0 | 0.0211 | 2.11 |
| 100 | 0.0100 | 2.0 | 0.0200 | 2.00 |
| 105 | 0.0095 | 2.0 | 0.0190 | 1.90 |
| 110 | 0.0091 | 2.0 | 0.0182 | 1.82 |
| 115 | 0.0087 | 2.0 | 0.0174 | 1.74 |
| 120 | 0.0083 | 2.0 | 0.0167 | 1.67 |

In one embodiment, the contact points 102 are located at a distance from each other that is a whole integer increment of the inverse of the stimulation frequency. Using the 60 Hz example above, one whole integer increment of the inverse of the stimulation frequency is 6.66 cm. Thus, in this 60 Hz example, the distances 106 between the contact points 102 are 6.66 cm. Using another example with a 110 Hz stimulation frequency, the wavelength is 1.82 cm per cycle. One whole integer increment of the inverse of the stimulation frequency is 3.64 cm. Thus, in this 110 Hz example, the distances 106 between the contact points 102 are 3.64 cm. Many other examples of frequencies and whole increments of the inverse of the frequencies are possible.

[1] The speed of sound in skin is approximately 2.0 m/s.

Figure 2A:
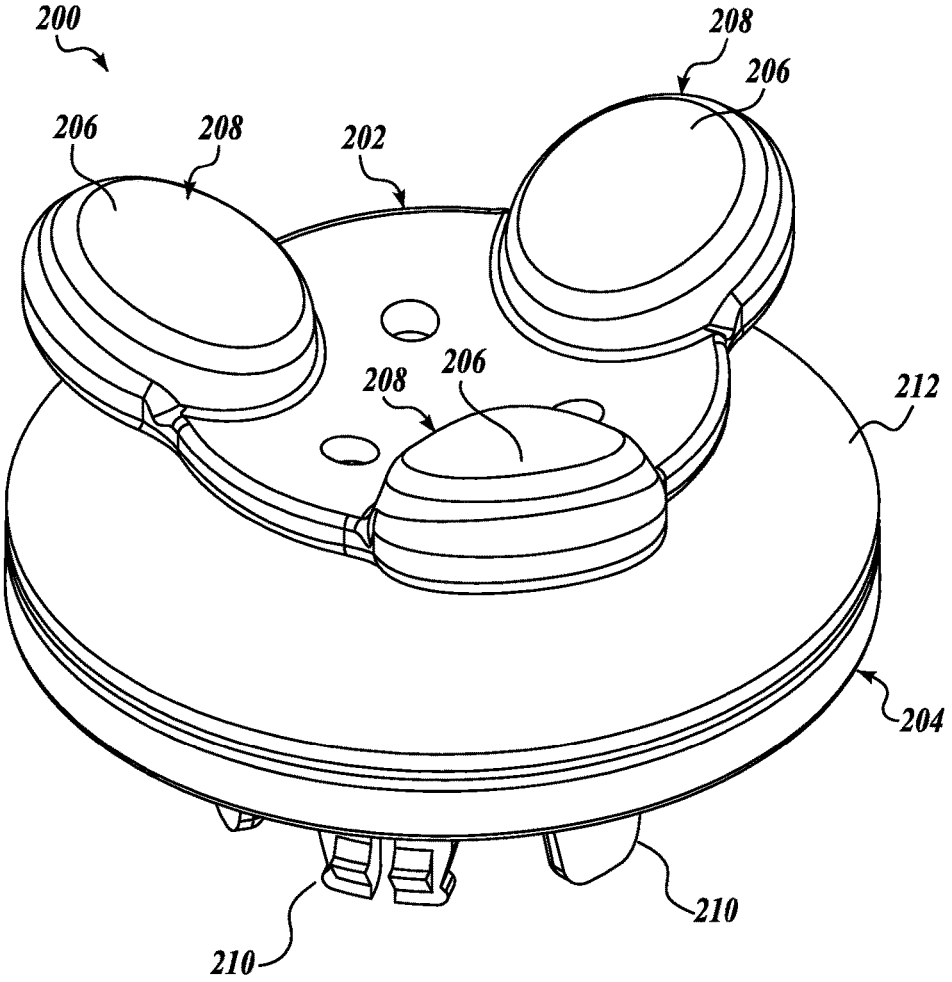
FIGS. 2A and 2B depict perspective views of another embodiment of an end effector that includes an end portion and a base portion.
Figure 2B:
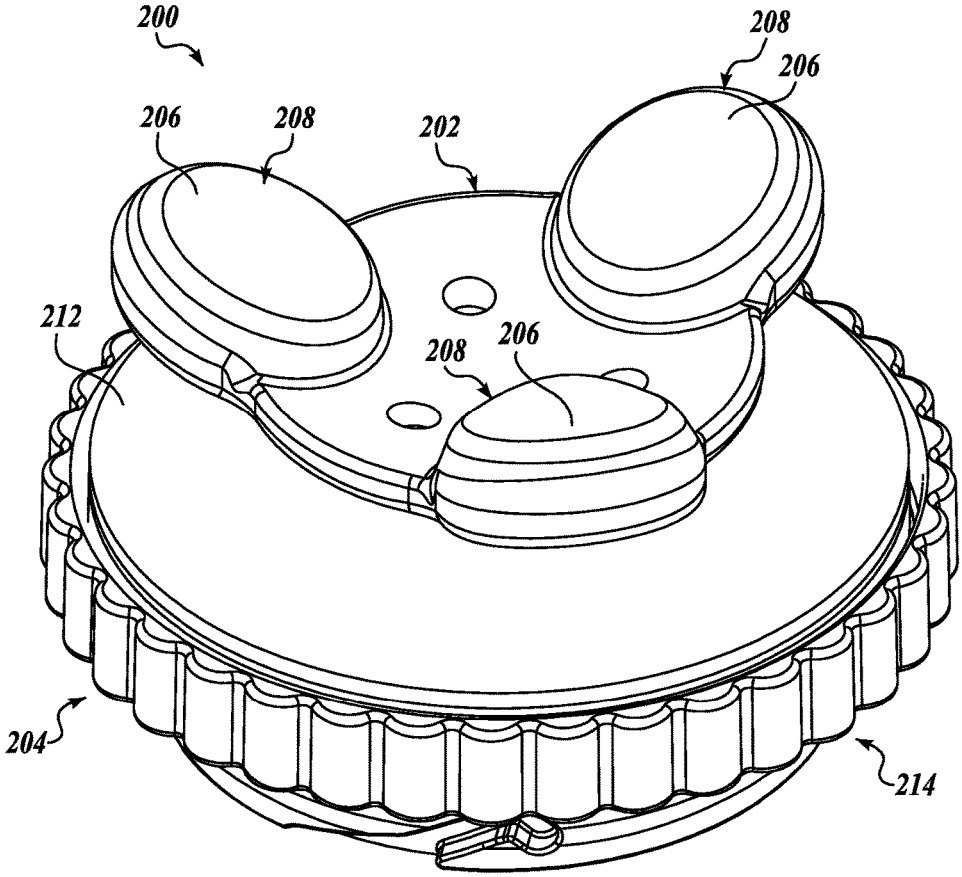

Another embodiment of an end effector 200 is depicted in FIGS. 2A and 2B. The end effector 200 includes an end portion 202 and a base portion 204. The end portion 202 includes contact points 206 and contact areas 208. Each of the contact points 206 is located on one of the contact areas 208. The base portion 204 includes a drive assembly 210 that is configured to engage a drive hub of an appliance (not shown). In one example, the appliance includes a motor that is operatively coupled to the drive hub. When the end effector 200 is releasably coupled to the appliance and the drive assembly 210 is engaged to the drive hub, operation of the motor causes movement of the drive hub that is transferred to the drive assembly to move the end effector.

As depicted in FIG. 2A, the end portion 202 of the end effector 200 is connected to the base portion 204 of the end effector 200 via a central support 212. The contact areas 206 are located on portions of the end portion 202 that are cantilevered out from the central support 212. In one embodiment, the end portion 202 is made of a non-rigid material and the contact areas 208 and the portions of the end portion 202 with the contact areas 208 have a spring-like quality that permits some movement of the contact areas 208. In one example, some or all of the base portion 204 is made of a rigid material. In this example, the portions of the end portion 202 with the contact areas 208 retain their spring-like quality even though some or all of the base portion 204 is made of a non-rigid material.

When the end effector 200 is coupled to a motor and the motor is operating, the system of the end effector 200 and the motor has a resonance frequency. The resonance frequency of the system is a function of characteristics of the system, such as operational parameters of the motor, mass of the motor, and mass of the end effector 200. In one embodiment, the end effector 200 is designed to be driven by a specific motor to stimulate a portion of skin at a stimulation frequency. In one example, the mass of the end effector 200 is selected such that the system of the end effector 200 and the specific motor has a resonance frequency based on the stimulation frequency. Selecting the mass of the end effector 200, in one example, includes selecting a mass of one or more of the end portion 202 or the base portion 204. In one example of a resonance frequency based on the stimulation frequency, the resonance frequency is approximately the same as the stimulation frequency. In other examples of resonance frequency based on the stimulation frequency, the resonance frequency is a whole integer increment of the stimulation frequency.

FIG. 2B depicts the end effector 200 that also includes a coupling ring 214. The coupling ring 214 is configured to couple the end effector 200 to another object, such as an appliance that includes a motor. Examples of end effectors coupled to appliances that include motors are described in greater detail below.

Figure 3:
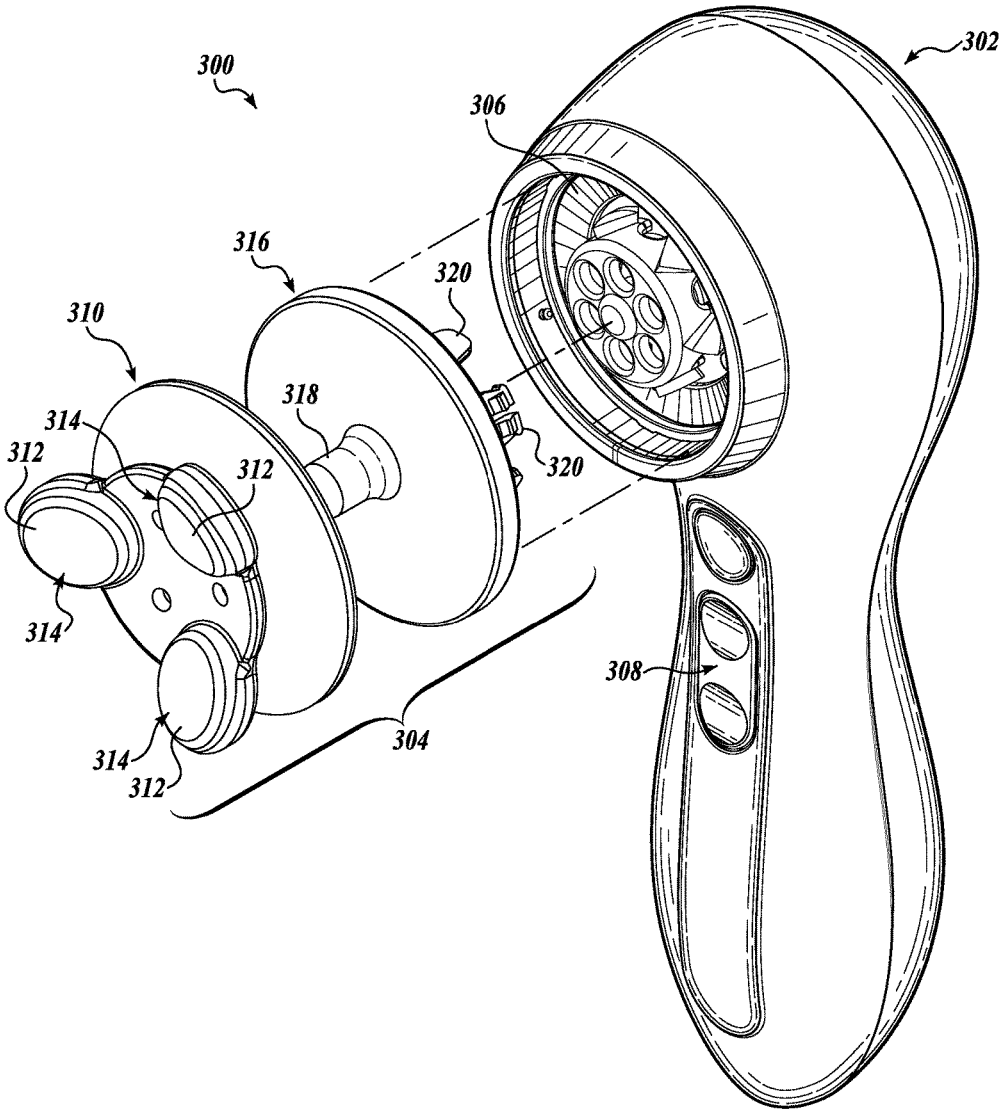
FIG. 3 depicts an embodiment of a system that includes an appliance and an end effector, in accordance with embodiments of end effectors described herein.

Embodiments of end effectors described herein are usable in a system, such as the system 300 depicted in FIG. 3. The system 300 includes an appliance 302 and an end effector 304. The appliance 302 depicted in FIG. 3 is in the form of a handle; however, the appliance 302 can take any number of other forms. The appliance 302 includes a drive hub 306. The appliance 302 includes a motor (not shown) that is operatively coupled to the drive hub 306 such that operation of the motor causes movement of the drive hub 306. The appliance 302 includes one or more user input mechanisms 308. In one embodiment, operation of the motor is based on user inputs received by the one or more user input mechanisms 308. In some examples, user input received by the one or more user input mechanisms 308 cause one or more of initiating operation of the motor, changing an operating characteristic of the motor, and ceasing operation of the motor.

In an embodiment, the end effector 304 depicted in FIG. 3 includes an end portion 310 and a base portion 316. The end portion includes a plurality of contact points 312. In one embodiment, the plurality of contact points 312 are located a distance from each other based on an inverse of a stimulation frequency. Each of the plurality of contact points 312 is located on one of a plurality of contact areas 314. The base portion 316 is coupled to the end portion 310 via a central support 318. The base portion includes a drive assembly 320 that is configured to engage the drive hub 306 of the appliance 302.

In an embodiment, the end effector 304 is physically coupleable to the appliance 302. When the end effector 304 is coupled to the appliance 302, the drive assembly 320 of the end effector 304 is engaged to the drive hub 306 of the appliance 302 such that operation of the motor of the appliance 302 causes movement of the drive hub 306 that is transferred to the drive assembly 320 of the end effector 304 to move the end effector. In one embodiment, operation of the motor imparts oscillating movement to the end effector 304 with an amount of inertia to move the end effector 304 at a target frequency and amplitude. In one example, the motor is configured to drive the end effector 304 at a frequency in a range from about 60 Hz to about 120 Hz. In another example, the motor is configured to drive the end effector 304 at an angular amplitude in a range from about 2° to about 7° of peak-to-peak motion. Such oscillating movement of the end effector 304, when applied to a portion of skin, produces a cyclical stimulus within the portion of skin at about the stimulation frequency. In some examples, the oscillating frequency is about the stimulation frequency. In other examples, the oscillating frequency is different from the stimulation frequency. In one example, the cyclical stimulus is a cyclical mechanical strain at the stimulation frequency which stimulates certain anti-aging effects of a target biomarker.

In an embodiment, the end effector 304 is communicatively coupled to the appliance 302 via one or more communication interfaces.

Figure 4:
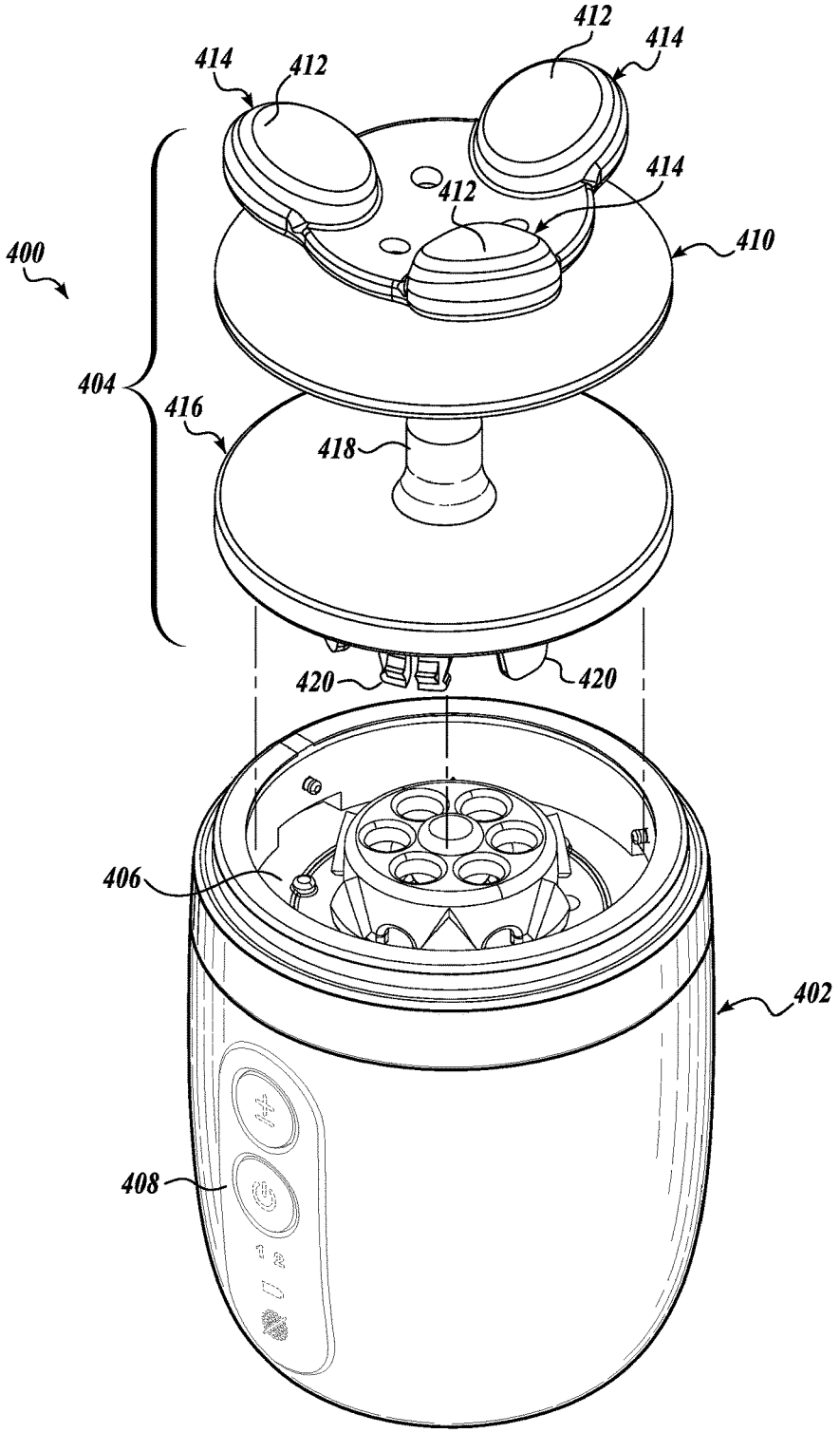
FIG. 4 depicts another embodiment of a system that includes an appliance and an end effector, in accordance with embodiments of end effectors described herein.

Another example of a system 400 with an appliance 402 and an end effector 404 is depicted in FIG. 4. The appliance 402 depicted in FIG. 4 is in the form of a hand-held appliance that is intended to be held against the palm of a user's hand with the user's fingers grasped around the appliance 402. While the appliance 402 is in the form of a hand-held appliance, the appliance 402 can take any number of other forms. The appliance 402 includes a drive hub 406. The appliance 402 includes a motor (not shown) that is operatively coupled to the drive hub 406 such that operation of the motor causes movement of the drive hub 406. The appliance 402 includes one or more user input mechanisms 408. In one embodiment, operation of the motor is based on user inputs received by the one or more user input mechanisms 408. In some examples, user input received by the one or more user input mechanisms 408 cause one or more of initiating operation of the motor, changing an operating characteristic of the motor, and ceasing operation of the motor.

The end effector 404 depicted in FIG. 4 includes an end portion 410 and a base portion 416. The end portion includes a plurality of contact points 412. In one embodiment, the plurality of contact points 412 are located a distance from each other based on an inverse of a stimulation frequency. Each of the plurality of contact points 412 is located on one of a plurality of contact areas 414. The base portion 416 is coupled to the end portion 410 via a central support 418. The base portion includes a drive assembly 420 that is configured to engage the drive hub 406 of the appliance 402.

In one embodiment, the end effector 404 is usable interchangeably with both appliance 302 and appliance 402. In other words, in this particular example, the drive assembly 420 of end effector 404 is separately engagable with both the drive hub 306 of appliance 302 and the drive hub 406 of appliance 402. In one embodiment, the appliance 302 and the appliance 402 have different characteristics, such as different motor sizes, different motor inertias, etc. In such a case, the system with the end effector 404 and the appliance 302 has a different resonant frequency than the system with the end effector 404 and the appliance 402. Because of the difference in resonance frequencies with different combinations of end effectors and appliances, in some embodiments, end effectors are designed (such as by selecting a particular mass of the end effectors) to operate with specific appliances and/or motors to have a target resonance frequency.

In one embodiment, the end effector 404 is operably coupleable to the appliance 402. For example, when the end effector 404 is coupled to the appliance 402, the drive assembly 420 of the end effector 404 is engaged to the drive hub 406 of the appliance 402 such that operation of the motor of the appliance 402 causes movement of the drive hub 406 that is transferred to the drive assembly 420 of the end effector 404 to move the end effector. In one embodiment, operation of the motor imparts oscillating movement to the end effector 304 with an amount of inertia to move the end effector 404 at a target frequency and amplitude. In one example, the motor is configured to drive the end effector 404 at a frequency in a range from about 60 Hz to about 120 Hz. In another example, the motor is configured to drive the end effector 404 at an angular amplitude in a range from about 2° to about 7° of peak-to-peak motion. Such oscillating movement of the end effector 404, when applied to a portion of skin, produces a cyclical stimulus within the portion of skin at about the stimulation frequency. In some examples, the oscillating frequency is about the stimulation frequency. In other examples, the oscillating frequency is different from the stimulation frequency. In one example, the cyclical stimulus is a cyclical mechanical strain at the stimulation frequency, which stimulates certain anti-aging effects of a target biomarker.

Figure 5:
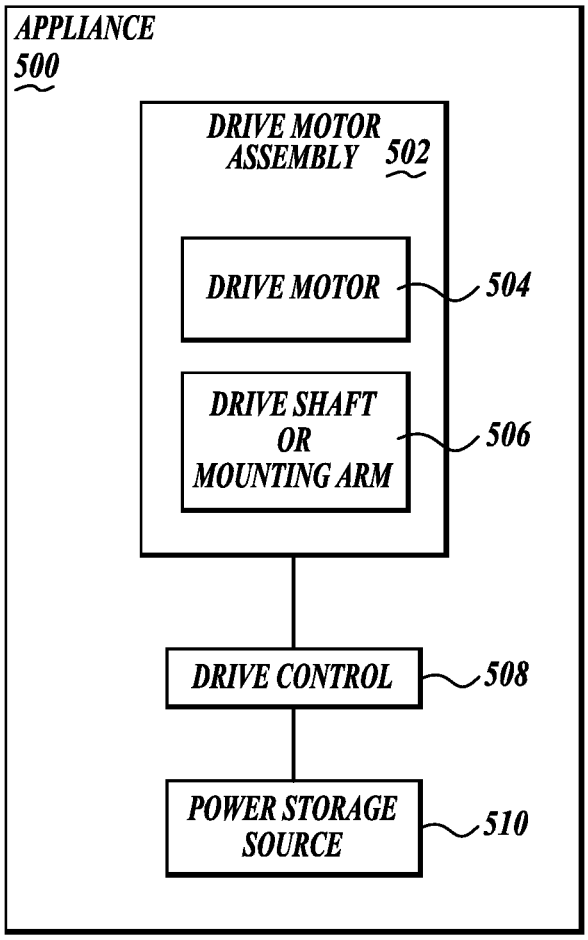
FIG. 5 depicts, in block diagrammatic form, an example of an operating structure of an appliance, in accordance with embodiments of appliances described herein.

FIG. 5 depicts, in block diagrammatic form, an example of operating structure of an appliance 500. The other embodiments of appliances described herein, such as appliance 302 and appliance 402, include, in some examples, an operating structure such as the operating structure shown in FIG. 5. In one embodiment, appliance 500 includes a drive motor assembly 502, a power storage source 510, such as a rechargeable battery, and a drive control 508. In one example, the drive control 508 is coupled to or includes one or more user interface mechanisms (e.g., the one or more user interface mechanisms 308 in FIG. 3 and the one or more user interface mechanisms 408 in FIG. 4). The drive control 570 is configured and arranged to selectively deliver power from the power storage source 510 to the drive motor assembly 502. In an embodiment, the drive control 508 includes a power adjust or mode control buttons coupled to control circuitry, such as a programmed microcontroller or processor, which is configured to control the delivery of power to the drive motor assembly 502. The drive motor assembly 502 in an embodiment includes an electric drive motor 504 (or simply motor 504) that drives an attached head, such as an end effector, via a drive gear assembly.

In one embodiment, when an end effector is coupled to the appliance 500 (e.g., such as when end effector 304 is coupled to appliance 302 in FIG. 3), the drive motor assembly 502 is configured to impart oscillatory motion to the end effector in a first rotational direction and a second rotational direction. In one embodiment, the drive motor assembly 502 includes a drive shaft 506 (also referred to as a mounting arm) that is configured to transfer oscillatory motion to a drive hub of the appliance 500. The appliance 500 is configured to oscillate the end effector at sonic frequencies. In an embodiment, the appliance 500 oscillates the end effector at frequencies from about 60 Hz to about 120 Hz. One example of a drive motor assembly 502 that may be employed by the appliance 500 to oscillate the end effector is shown and described in U.S. Pat. No. 7,786,646. However, it should be understood that this is merely an example of the structure and operation of one such appliance and that the structure, operation frequency and oscillation amplitude of such an appliance could be varied, depending in part on its intended application and/or characteristics of the applicator head, such as its inertial properties, etc. In an embodiment of the present disclosure, the frequency ranges are selected so as to drive the end effector at near resonance. Thus, selected frequency ranges are dependent, in part, on the inertial properties of the attached head. It will be appreciated that driving the attached head at near resonance provides many benefits, including the ability to drive the attached head at suitable amplitudes in loaded conditions (e.g., when contacting the skin). For a more detailed discussion on the design parameters of the appliance, please see U.S. Pat. No. 7,786,646.

Figure 6A:
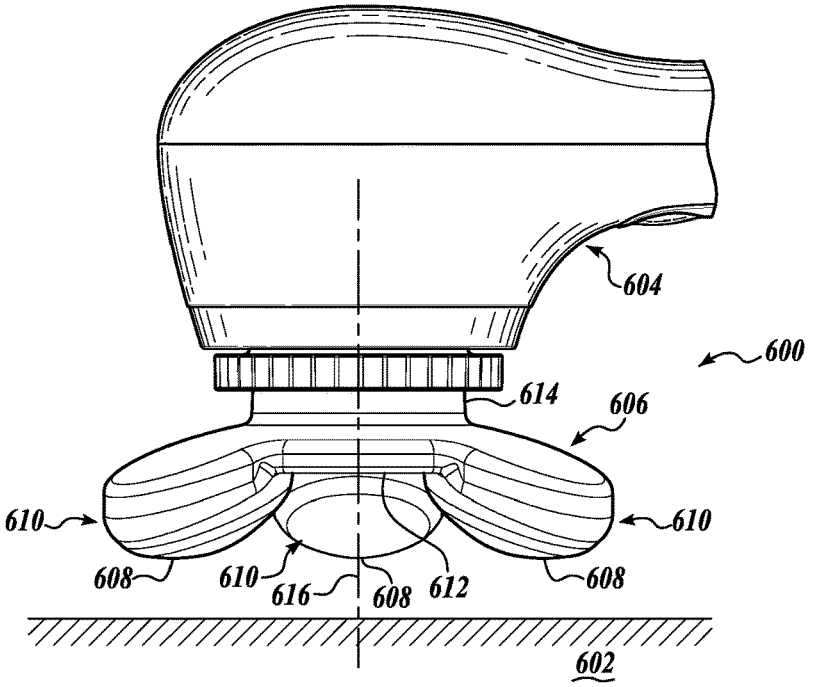
FIGS. 6A and 6B depict, respectively, an unloaded condition and a loaded condition of an embodiment of a system with an appliance and an end effector against a portion of skin.
Figure 6B:
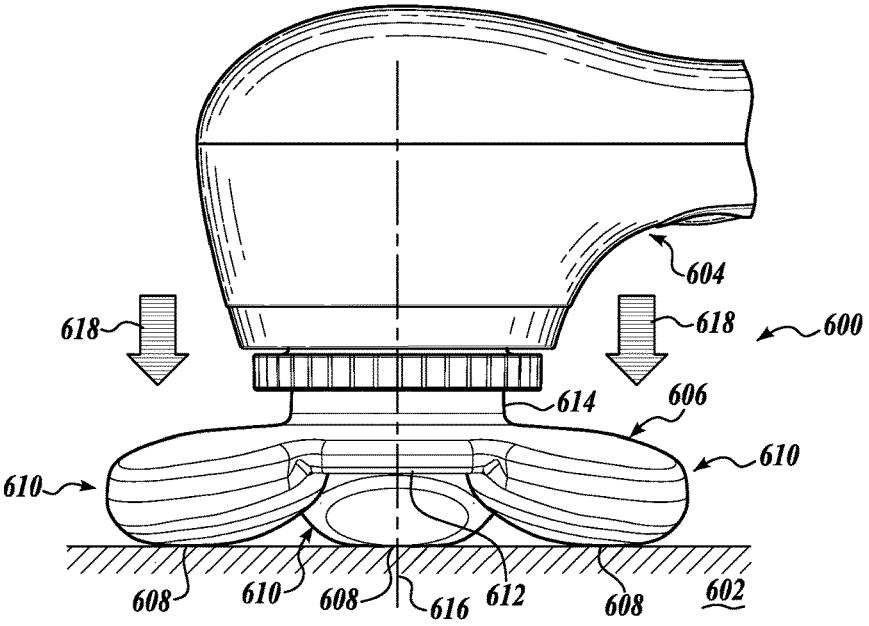

FIGS. 6A and 6B depict, respectively, an unloaded condition and a loaded condition of a system 600 against a portion of skin 602. The system includes an appliance 604 coupled to an end effector 606. The end effector 606 includes a plurality of contact points 608. In one embodiment, the plurality of contact points 608 are located a distance from each other based on an inverse of a stimulation frequency. Each of the plurality of contact points 608 is located on one of a plurality of contact areas 610. The end effector has a central portion 612 located between the plurality of contact areas 610. The end effector 606 is coupled to appliance 604 via a central support 614 that is located opposite of the central portion 612. The portions of the end effector 606 that include the contact areas 610 are cantilevered out away from the central support 614.

In the embodiment shown in FIG. 6A, the system 600 is in an unloaded state (i.e., the end effector 606 is not in contact with the portion of skin). The appliance includes a motor that moves the end effector 606. In one embodiment, the motor imparts oscillating movements to the end effector 606 about an axis 616. When the motor is operating, the system 600 has a resonant frequency based on a desired stimulation frequency. In one embodiment, the stimulation frequency is selected based on an anti-aging effect stimulated by a cyclical stimulus within the portion of skin at the stimulation frequency. As shown in FIG. 6A, the end effector 606 has a cupped shape where the contact points 608 are located closer to the portion of skin 602 than the central portion 612. From the point shown in FIG. 6A, as the system 600 is lowered to the portion of skin 602, the contact points 608 are the first portions of the system 600 to contact the portion of skin 602.

In the embodiment shown in FIG. 6B, a force 618 is applied to the system 600 to bias the end effector 606 toward the portion of skin 602. In one embodiment, the force 618 applied to the system 600 is in a range from about 85 grams-force (approximately 0.83 N) to about 100 grams-force (approximately 0.98 N). In the embodiment shown in FIG. 6B, the force 618 applied to the system 600 causes the cantilevered portions of the end effector 606 to deflect toward the appliance 604. Such a deflection of the cantilevered portions is possible, in some examples, because the cantilevered portions of the end effector 606 are made of a non-rigid material. While the deflection of the cantilevered portions of the end effector 606 may modify the cup shape of the end effector 606, the force 618 does not cause the central portion 612 to touch the portion of skin 602. Thus, only the contact areas 610 remain in contact with the portion of skin 602 when the force 618 is applied. Any contact of the end effector 606 with the portion of skin 602, other than the contact between the contact areas 610 and the end effector 606, may disrupt any cyclical stimulus of the portion of skin 602 by the end effector 606.

With the force 618 applied to the system 600, the operating motor of the appliance 604 continues to move the end effector 606. The movement of the end effector 606 when the force 618 is applied to the system 600 produces a cyclical stimulus within the portion of skin 602 at about the stimulation frequency. In one example, the cyclical stimulus is a wave-based mechanical strain that propagates through the portion of skin 602. The location of the plurality of contact points 608 (i.e., at a distance from each other based on an inverse of a stimulation frequency) encourages propagation of the cyclical stimulus because the cyclical stimulus created by each of the plurality of contact points 608 is in phase with the other(s) of the plurality of contact points 608. In other words, one of the plurality of contact points 608 does not cancel out the cyclical stimulus created by another one of the plurality of contact points 608.

Interaction between contact areas of an end effector and portions of skin is affected by more than just the location of the contact areas. FIGS. 7A through 7F depict embodiments of contact areas and examples of results of the embodiments of contact areas on skin displacement. The contact areas depicted in FIGS. 7A through 7F are capable of being used with embodiments of end effectors described here. In addition, the contact areas of an end effector are usable to apply treatment compositions to a portion of skin. In various embodiments, the treatment compositions described herein are one or more of a cosmetic composition (e.g., makeup, foundation, bronzer, etc.), a medical ointment (e.g., antibacterial ointment, hydrocortisone cream, etc.), a cleanser (e.g., soap, makeup remover, etc.), or any other composition that is capable of being applied to a portion of skin. In various embodiments, a treatment composition is a liquid, a non-Newtonian substance, a gel, or any other type of composition.

Figure 7A:
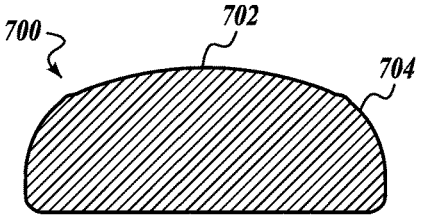
FIGS. 7A through 7H depict embodiments of contact areas that are usable with embodiments of end effectors described herein and examples of results of the embodiments of contact areas on skin displacement.
Figure 7B:
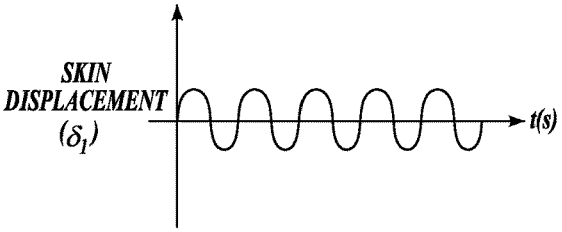

FIG. 7A depicts a side view of an embodiment of a contact area 700. The contact area includes a smooth face 702 and a rounded shoulder 704. In some embodiments, with used in an end effector with a plurality of contact areas, the smooth face 702 includes a contact location that is configured to contact a portion of skin. The rounded shoulder 704 has a radius that does not provide a noticeable edge to the face 702. FIG. 7B depicts a chart showing an example of skin displacement $\delta_1$ of a portion of skin over time when the portion of skin is in contact with the contact area 700 and the contact area 700 produces a cyclical stimulus within the portion of skin.

Figure 7C:
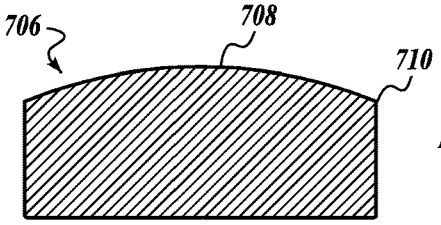
Figure 7D:
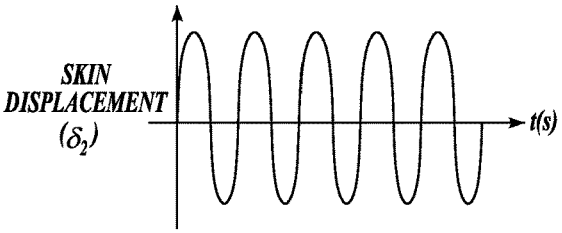

FIG. 7C depicts a side view of an embodiment of a contact area 706. The contact area includes a smooth face 708 and a rounded shoulder 710. In some embodiments, when used in an end effector with a plurality of contact areas, the smooth face 708 includes a contact location that is configured to contact a portion of skin. The rounded shoulder 710 has a radius that provides a noticeable edge to the face 708. In the embodiments shown in FIGS. 7A and 7C, the radius of the rounded shoulder 710 is less than the radius of the rounded shoulder 704. FIG. 7D depicts a chart showing an example of skin displacement $\delta_2$ of a portion of skin over time when the portion of skin is in contact with the contact area 706 and the contact area 706 produces a cyclical stimulus within the portion of skin. Comparing the charts in FIGS. 7B and 7D, the cyclical stimuli shown have the same frequency, but the skin displacement $\delta_2$ using the rounded shoulder 710 on the contact area 706 is greater than the skin displacement $\delta_1$ using the rounded shoulder 704 on the contact area 700. The greater skin displacement $\delta_2$ is due to the greater friction between the portion of skin and the noticeable edge provided by the rounded shoulder 710 on the face 708.

Figure 7E:
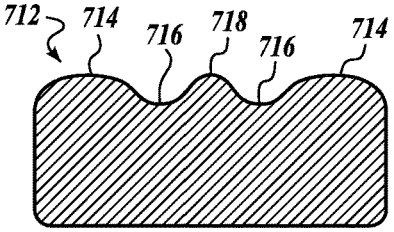
Figure 7F:
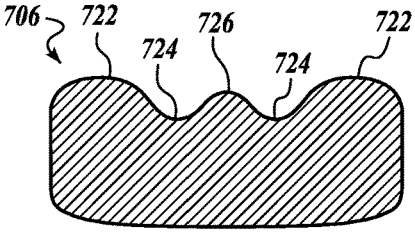

FIGS. 7E and 7F depict cross-sectional views of two embodiments of contact areas with slits across faces of the contact areas. FIG. 7E depicts a cross-sectional view of a contact area 712 that has a face 714. The contact area 712 also has two slits 716 across the face 714. While the embodiment of contact area 712 has two slits, in other embodiments, contact areas have other numbers of slits, such as one slit across the face. Between the two slits 716, a portion 718 of the contact area 712 returns back to approximately the same level of the face 714. The recesses in the face 714 created by the slits 716 are capable of containing treatment composition as the contact area 712 is moved across a portion of skin. In this way, the recesses in the face 714 created by the slits 716 function as a small reservoir to more evenly spread treatment composition across a portion of skin. The slits 716 also provide distinct edges on the face 714 that provide greater friction between the contact area 712 and the portion of skin to cause greater skin displacement in the portion of skin.

FIG. 7F depicts a cross-sectional view of a contact area 720 that has a face 722. The contact area 720 also has two slits 724 across the face 722. While the embodiment of contact area 722 has two slits, in other embodiments, contact areas have other numbers of slits, such as one slit across the face. Between the two slits 724, a portion 726 of the contact area 720 is raised above the deepest parts of the two slits 724, but is recessed back from the level of the face 722. The recess in the face 722 created by the slits 724 and the recessed portion 726 is capable of containing treatment composition as the contact area 720 is moved across a portion of skin. In this way, the recess in the face 722 created by the slits 724 and the recessed portion 726 functions as a small reservoir to more evenly spread treatment composition across a portion of skin. The recess in the face 722 created by the slits 724 and the recessed portion 726 also provides friction between the contact area 720 and the portion of skin to cause greater skin displacement in the portion of skin.

Figure 7G:
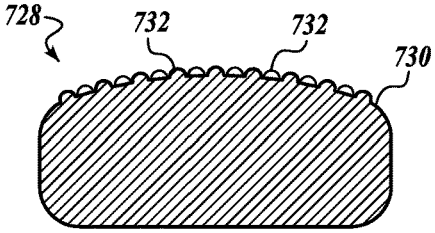
Figure 7H:
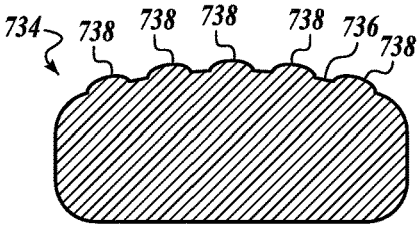

FIGS. 7G and 7H depict side views of embodiments of contact areas with surface texturing on their faces. FIG. 7G depicts a side view of a contact area 728. The contact area 728 includes a face 730 with surface texturing in the form of dimples 732 on the face 730. FIG. 7H depicts a side view of a contact area 734. The contact area 734 includes a face 736 with surface texturing in the form of linear bumps 738 on the face 736. In other embodiments, other forms of surface texturing are used on the faces of contact areas. Examples of the benefits of surface texturing on the face of a contact area include one or more of better application of treatment composition into a portion of skin, greater skin displacement by the contact area, or improved sensation of the operation of the contact area against the portion of skin.

FIGS. 8A through 8D depict top views of embodiments of end effectors with different numbers and arrangements of contact areas. Each of FIGS. 8A through 8D depicts a top view of an end effector 800A-D. Each end effector 800A-D includes a plurality of contact points 802A-D. Each of the contact points 802A-D is located on one of a plurality of contact areas 804A-D. Each end effector 800A-D also includes a central portion 806A-D that is recessed away from the contact areas 804A-D such that the contact points 802A-D are the first portions of the end effectors 800A-D that would contact a portion of skin.

Figure 8A:
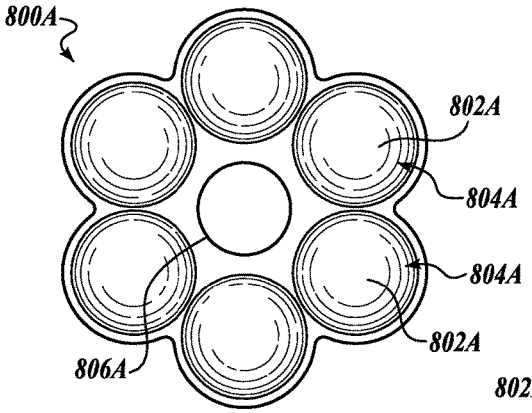
FIGS. 8A through 8D depict top views of additional embodiments of end effectors with different numbers and arrangements of contact areas.
Figure 8B:
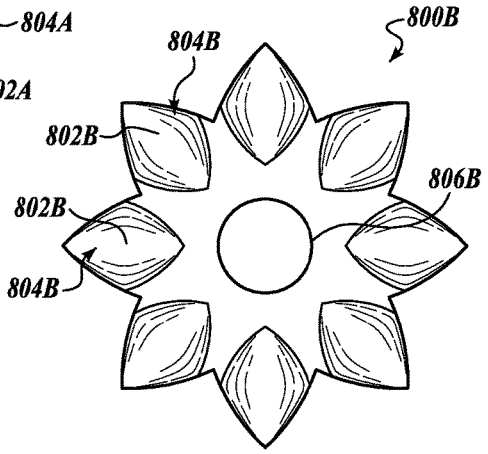
Figure 8C:
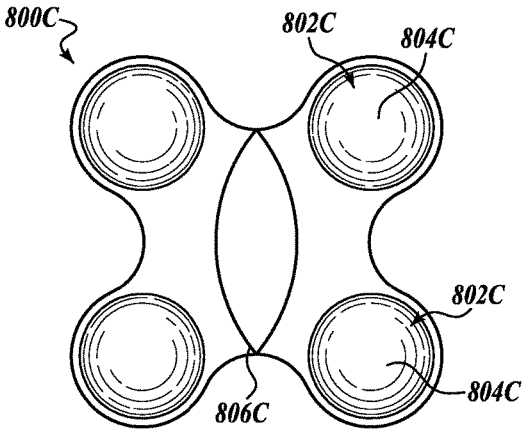
Figure 8D:
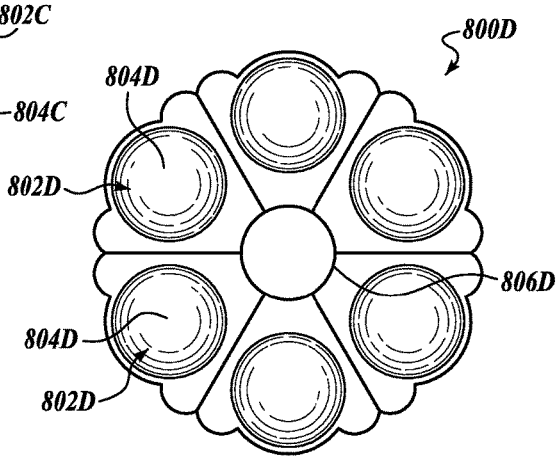

The end effectors 800A-D have different numbers and arrangements of contact areas 804A-D. More specifically, as depicted in FIG. 8A, the end effector 800A has a flower arrangement with a circular central portion 806A and six circular contact areas 804A around the circular central portion 806A. As depicted in FIG. 8B, the end effector 800B has an arrangement that is a variation of a flower arrangement. The end effector 800B has a circular central portion 806B and eight pointed contact areas 804B around the circular central portion 806B. As depicted in FIG. 8C, the end effector 800C has a butterfly arrangement with a central portion 806C with a vesica piscis shape and four contact areas 804C. The four contact areas 804C are arranged with two sets of two contact areas 804C on each side of the central portion 806C. As depicted in FIG. 8D, the end effector 800D has a pie-shaped arrangement with a circular central portion 806B and six pie-piece-shaped contact areas 804D around the circular central portion 806D. Many other variations on the number and arrangement of contact areas on an end effector are possible.

Each of the embodiments of end effectors 800A-D depicted in FIGS. 8A through 8D include a plurality of contact points 802A-D. In one example, the contact points 802A-D are located at a target distance from each other that is based on an inverse of the stimulation frequency. It may not be possible to locate four or more contact points equidistantly from each other. For example, with four contact points located at corners of a square, a contact point may be equidistantly located from the other contact points at neighboring corners, but will not be equidistantly located from the contact point that is across the diagonal of the square. However, even if it may not be possible for four or more contact points to be located equidistantly from each other, four or more contact points may be located at a target distance from each other that is based on an inverse of the stimulation frequency. For example, the four or more contact points may be located at a target with respect to each other such that the individual ones of the four or more contact points do not cancel out cyclical stimulus generated by the others of the four or more contact points.

Figure 9A:
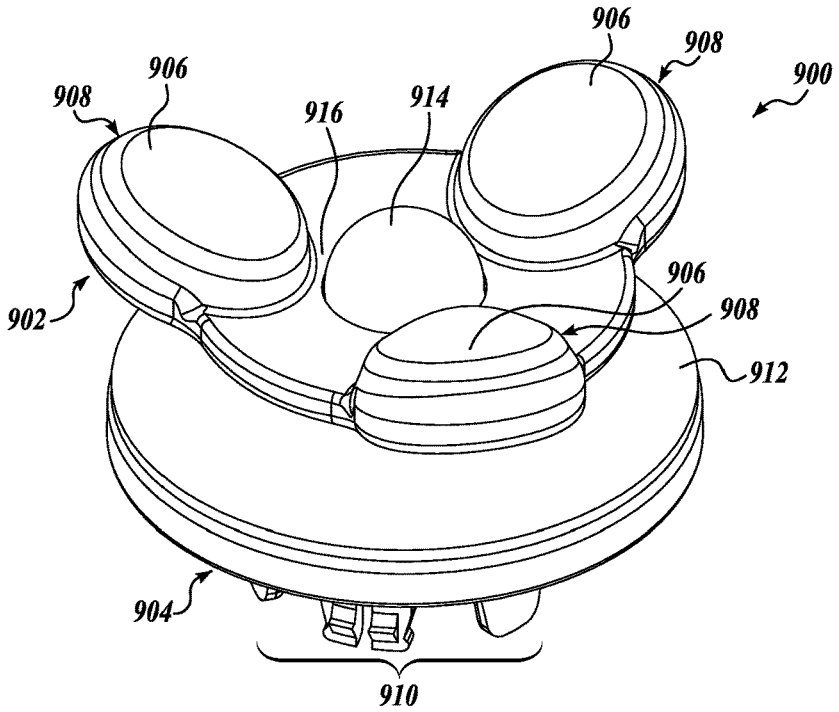
FIGS. 9A, 9B, and 9C depict, respectively, perspective, side, and exploded views of an embodiment of an end effector with a ball dispenser.
Figure 9B:
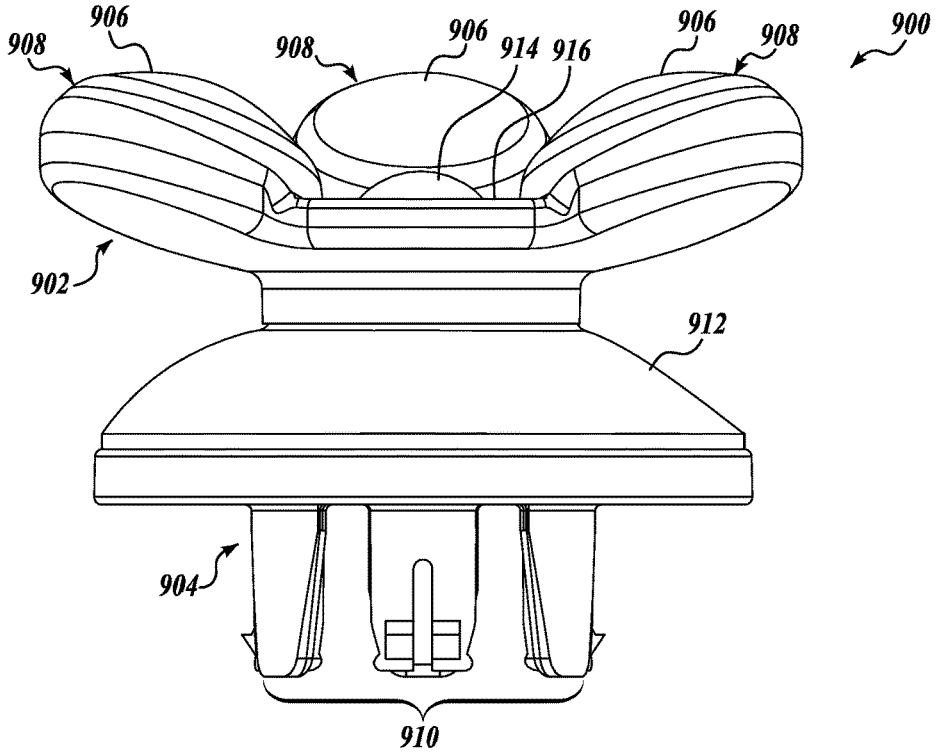
Figure 9C:
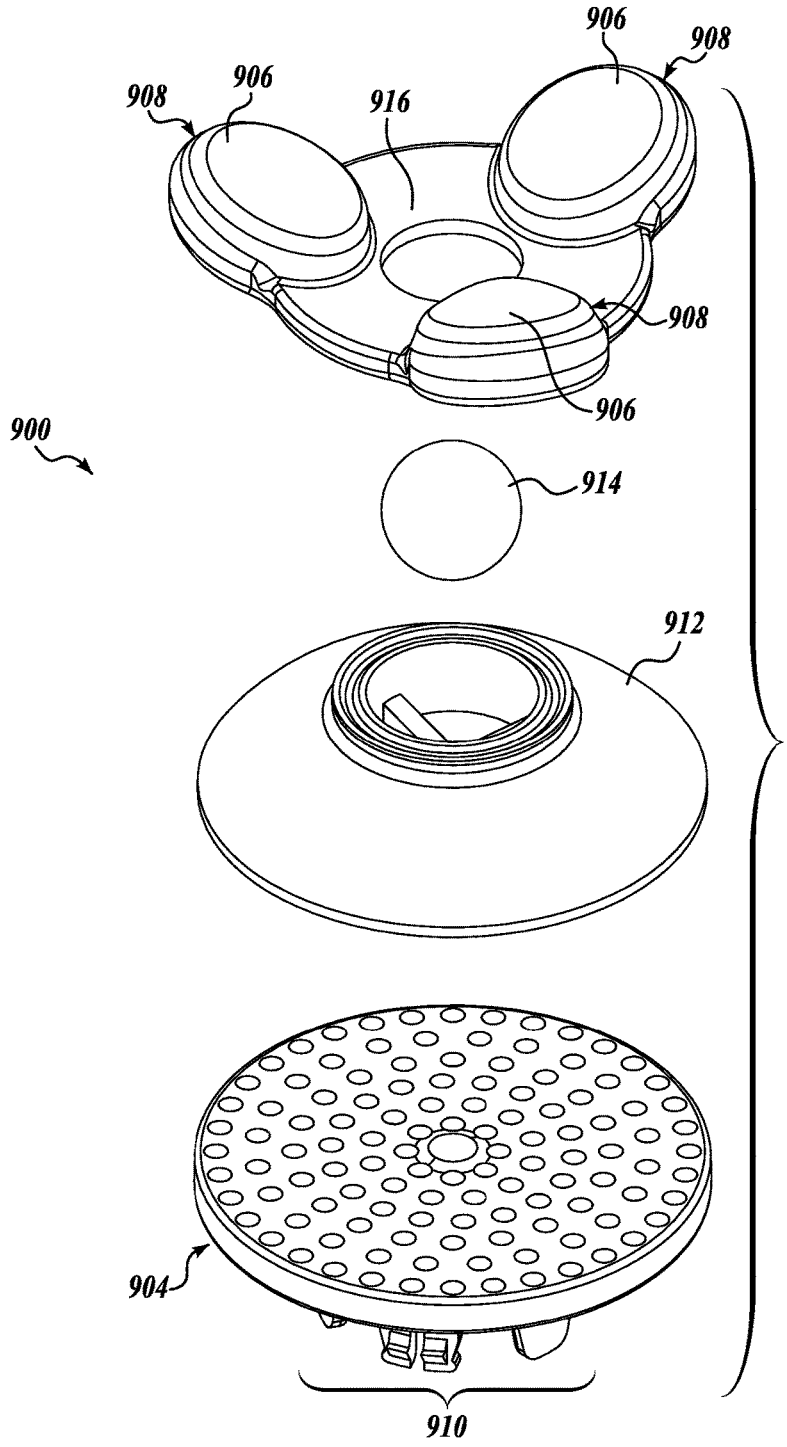

Another embodiment of an end effector is depicted in FIGS. 9A through 9C with a ball dispenser that is configured to dispense treatment composition to a portion of skin. More specifically, FIGS. 9A, 9B, and 9C depict, respectively, perspective, side, and exploded views of an end effector 900. The end effector 900 includes an end portion 902 and a base portion 904. The end portion 902 of the end effector 900 has a plurality of contact points 906. Each of the plurality of contact points 906 is located on one of a plurality of contact areas 908. The contact points 906 are located at a target distance from each other that is based on an inverse of a stimulation frequency. The base portion 904 includes a drive assembly 910 that is configured to be engaged to a drive hub of an appliance. The base portion 904 is coupled to the end portion 902 via a central support 912. The contact areas 908 are located on the end portion 902 such that the contact areas 908 are cantilevered out from the central support 912.

In an embodiment, the end effector 900 also includes a dispenser 914 located in a central portion 916 of the end portion 902 of the end effector 900. In an embodiment, the dispenser 914 is located on a different location of the end portion 902, such as one of the plurality of contact points 906. As shown in FIG. 9B, the ball dispenser 914 does not extend away from the central portion 916 as far as the plurality of contact points 906 extend away from the central portion 916. In this way, in one example, the plurality of contact points 906 are biased toward a portion of skin when a first force is applied to the end effector 900 without the ball dispenser 914 touching the portion of skin. When the first force is applied to bias the end effector 900 toward the portion of skin and a motor is operated to move the end effector, a cyclical stimulus is produced within the portion of skin at about a stimulation frequency. In another example, when a second force, that is greater than the first force, is applied to the end effector 900, the ball dispenser 914 touches the portion of skin.

In one embodiment, when the ball dispenser 914 touches the portion of skin, the ball dispenser 914 dispenses a treatment composition to the portion of skin. In one embodiment, the treatment composition is located within the base portion 904, such as within at least the central support 912. In one embodiment, when the ball dispenser 914 touches the portion of skin, the ball dispenser 914 rolls, causing some of the treatment composition located within the base portion 904 to be dispensed to the portion of skin. As the end effector 900 continues to be moved over the portion of skin, the contact areas 906 apply the dispensed treatment composition over the surface of the portion of skin.

The embodiment of the end effector 900 depicted in FIGS. 9A to 9C includes a ball dispenser 914. However, ball dispensers are not the only type of dispensers that are capable of being used with end effectors. In other embodiments, end effectors include treatment composition dispensers other than ball dispensers to dispense treatment composition to a portion of skin.

Figure 10:
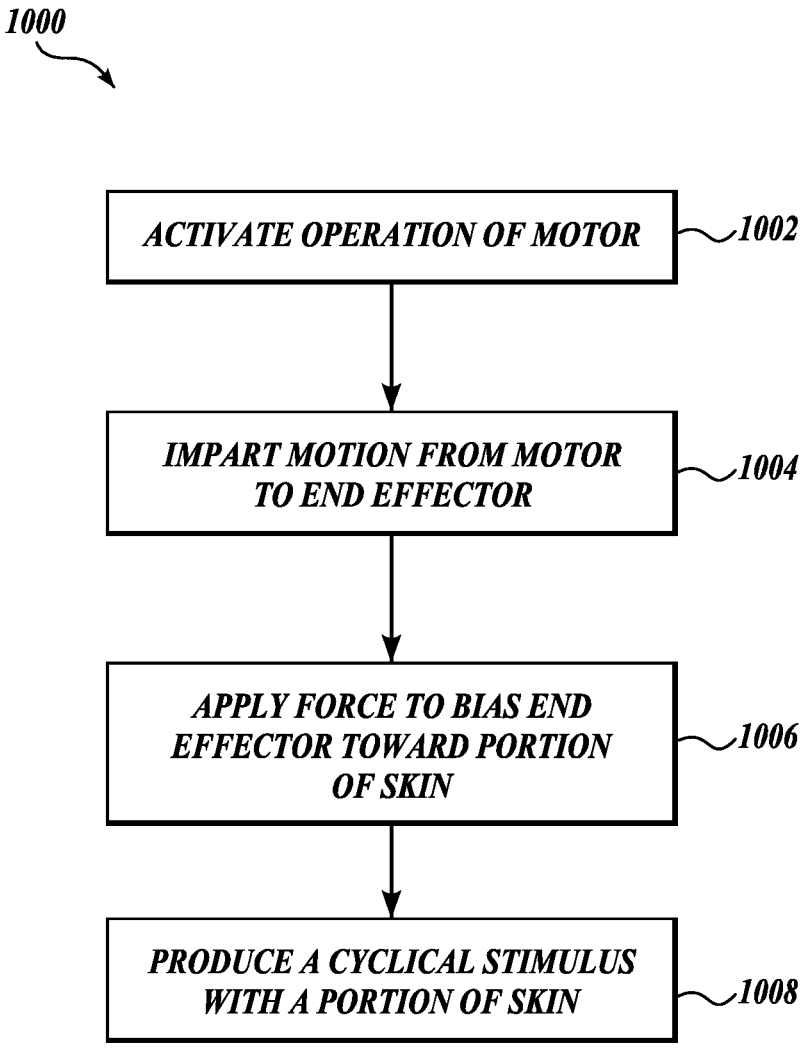
FIG. 10 depicts an embodiment of a method that is capable of being performed using embodiments of systems described herein with motors coupled to end effectors.

Embodiments of systems described herein with motors coupled to end effectors are capable of being used to perform a method 1000 depicted in FIG. 10. At box 1002, operation of the motor is activated. In one example, the motor is located within an appliance and the motor is activated by a user input received by the appliance via one or more user input mechanisms. At block 1004, motion is imparted from the motor to the end effector. In one example, the motor is operatively coupled to a drive hub that engages a drive assembly of the end effector, and the operation of the motor moves the end effector in an oscillating manner. In one embodiment, operation of the motor causes the system to have a resonant frequency based on the stimulation frequency. At block 1006, a force is applied to the end effector to bias the end effector toward the portion of skin such that a plurality of contact points of the end effector contact the portion of skin. In one example, the plurality of contact points are located at a distance from each other that is based on an inverse of the stimulation frequency. At block 1008, the combination of the motor operating and the force being applied to bias the end effector toward the portion of skin causes the end effector to produce a cyclical stimulus within the portion of skin at about the stimulation frequency.

In some embodiments, the method 1000 includes additional steps described herein that are not depicted in FIG. 10. In one example, the method 1000 includes applying a composition configured to treat a condition of the portion of skin. In another example, the method 1000 includes applying a composition configured to treat a condition of the portion of skin. In another example, the method 1000 includes selecting the stimulation frequency based on the condition of the portion of skin.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A system for stimulating a portion of skin at a stimulation frequency, the system comprising:

an appliance having a motor; and an end effector operably coupled to the motor, the end effector including a plurality of contact points at which the end effector is configured to contact the portion of skin;

wherein the plurality of contact points are located at a distance from each other that is based on an inverse of the stimulation frequency;

wherein the motor is configured to move the end effector, and wherein the system is configured such that, when the motor is moving the end effector, the system has a resonant frequency based on the stimulation frequency;

wherein, when the motor is operating and a force is applied to the system to bias the end effector against the portion of skin, the end effector produces a cyclical stimulus within the portion of skin at the stimulation frequency, wherein the end effector includes a base portion and an end portion, wherein the end portion includes the plurality of contact points, wherein the end portion is connected to the base portion via a central support such that the plurality of contact points are cantilevered out away from the central support, wherein the end portion comprises a non-rigid material and the plurality of contact points and portions of the end portion with the contact points have a spring-like quality that permits deflection of the plurality of contact points, and wherein when the force is applied and the plurality of contact points are deflected a surface of the end effector opposite the plurality of contact points is substantially parallel to the portion of skin, wherein the end effector includes a base portion and an end portion, wherein the end portion includes the plurality of contact points, and wherein the end portion is connected to the base portion via a central support such that the plurality of contact points are cantilevered out away from the central support.

2. The system of claim 1, wherein the end effector includes a cup-shaped end configured such that when the force is applied from the portion of skin, and the force is in a range from 85 grams-force to 100 grams-force, the plurality of contact points are the only portions of the end effector to contact the portion of skin, the plurality of contact points are the only portions of the end effector to contact the portion of skin.

3. The system of claim 1, wherein the motor is configured to impart one or more of oscillatory motion, vibrational motion, or cyclical mechanical strain to the end effector.

4. The system of claim 1, wherein the end effector is releasably couplable to the appliance, wherein the end effector includes a drive assembly that engages a drive hub of the appliance when the end effector is releasably coupled to the appliance, and wherein the motor is operatively coupled to the drive hub such that operation of the motor causes movement of the drive hub that is transferred to the drive assembly to move the end effector.

5. An end effector for stimulating a portion of skin at a stimulation frequency, the end effector comprising:

a base portion that is couplable to a motor;

an end portion having a plurality of contact points at which the end effector is configured to contact the portion of skin, wherein the plurality of contact points are located at a target distance from each other that is based on an inverse of the stimulation frequency;

wherein the end effector is configured such that, when the base portion is coupled to the motor and the motor is operating at a resonant frequency of the end effector, the end effector has a resonant frequency based on the stimulation frequency; and wherein, when the motor is operating and a force is applied to bias the end effector toward the portion of skin, a cyclical stimulus is produced within the portion of skin at the stimulation frequency, wherein the end effector includes a base portion and an end portion, wherein the end portion includes the plurality of contact points, wherein the end portion is connected to the base portion via a central support such that the plurality of contact points are cantilevered out away from the central support, wherein the end portion comprises a non-rigid material and the plurality of contact points and portions of the end portion with the contact points have a spring-like quality that permits deflection of the plurality of contact points, and wherein when the force is applied and the plurality of contact points are deflected a surface of the end effector opposite the plurality of contact points is substantially parallel to the portion of skin, wherein the end portion is connected to the base portion via a central support such that the plurality of contact points are cantilevered out away from the central support.

6. The end effector of claim 5, wherein the plurality of contact points includes at least three contact points arranged equidistantly from each other.

7. The end effector of claim 6, wherein a distance between each set of two of the at least three contact points is a whole increment of the inverse of the stimulation frequency.

8. The end effector of claim 5, wherein each of the plurality of contact points is located on one of a plurality of pads, and wherein edges of each of the plurality of pads have a rounded shoulder.

9. The end effector of claim 5, wherein each of the plurality of contact points is located on one of a plurality of pads, and wherein each of the plurality of pads has at least one of a rounded shoulder, at least one slit across a face of the pad, or surface texturing on a face.

10. The end effector of claim 5, wherein a surface of the end portion has a hardness in a range from 10 Shore A to 60 Shore A.

11. The end effector of claim 5, the end effector further comprising:

a ball dispenser configured to dispense a treatment composition to the portion of skin in response to the ball dispenser coming into contact with the portion of skin.

12. The end effector of claim 5, wherein the stimulation frequency is in a range from 60 Hz to 120 Hz.

13. The end effector of claim 5, wherein the end effector includes a cup-shaped end configured such that when the force is applied from the end effector to the portion of skin, and wherein the force applied from the end effector to the portion of skin is in a range from 85 grams-force to about 100 grams-force, the plurality of contact points are the only portions of the end effector to contact the portion of skin.

14. A method of treating a portion of skin at a stimulation frequency using an appliance comprising a motor coupled to an end effector, the method comprising:

driving at a resonant frequency the end effector, the end effector including a base portion and an end portion, wherein the end portion includes a plurality of contact points located at a distance from each other that is based on an inverse of the stimulation frequency, wherein the end portion is connected to the base portion via a central support such that the plurality of contact points are cantilevered out away from the central support, wherein the end portion comprises a non-rigid material and the plurality of contact points and portions of the end portion with the contact points have a spring-like quality that permits deflection of the plurality of contact points, and wherein when the force is applied and the plurality of contact points are deflected a surface of the end effector opposite the plurality of contact points is substantially parallel to the portion of skin; and inducing a cyclical stimulus at the stimulation frequency within a portion of skin contacted by the plurality of contact points.

15. The method of claim 14, further comprising:

applying a composition to the portion of skin using the end effector while driving the end effector at the resonant frequency.

16. The method of claim 15, wherein applying the composition includes applying a composition configured to treat a condition of the portion of skin.

17. The method of claim 16, wherein driving the end effector at the resonant frequency includes selecting the stimulation frequency based on the condition of the portion of skin.

18. The system of claim 1, wherein the stimulation frequency is in a range from 60 Hz to 120 Hz.

19. The system of claim 1, wherein the end portion comprises a non-rigid material and the plurality of contact points and portions of the end portion with the plurality of contact points have a spring-like quality that permits deflection of the plurality of contact points.

* * * * *